US011069320B2

(12) United States Patent
Han et al.

(10) Patent No.: US 11,069,320 B2
(45) Date of Patent: Jul. 20, 2021

(54) CHIP-ON-FILM AND DISPLAY DEVICE

(71) Applicants: HEFEI BOE DISPLAY TECHNOLOGY CO., LTD., Anhui (CN); BOE TECHNOLOGY GROUP CO., LTD., Beijing (CN)

(72) Inventors: Yizhan Han, Beijing (CN); Ke Dai, Beijing (CN); Liugang Zhou, Beijing (CN)

(73) Assignees: HEFEI BOE DISPLAY TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/668,211

(22) Filed: Oct. 30, 2019

(65) Prior Publication Data

US 2020/0243039 A1 Jul. 30, 2020

(30) Foreign Application Priority Data

Jan. 29, 2019 (CN) ..... 201920184093.6

(51) Int. Cl.
*G09G 5/00* (2006.01)

(52) U.S. Cl.
CPC ..... *G09G 5/006* (2013.01); *G09G 2310/0267* (2013.01); *G09G 2310/0275* (2013.01)

(58) Field of Classification Search
CPC ..... G09G 5/006; G09G 2310/0267; G09G 2310/0275; G09G 2300/0413; G09G 2300/0408; G09G 2300/0426; G09G 3/20
See application file for complete search history.

(56) References Cited

U.S. PATENT DOCUMENTS

| | | | | |
|---|---|---|---|---|
| 6,525,718 | B1 * | 2/2003 | Murakami | G02F 1/13452 345/103 |
| 2005/0007520 | A1 * | 1/2005 | Hiruma | G02F 1/1341 349/86 |
| 2019/0043420 | A1 * | 2/2019 | Jung | G09G 3/3225 |
| 2019/0206898 | A1 * | 7/2019 | Baek | H01L 27/124 |
| 2020/0365107 | A1 * | 11/2020 | Li | G09G 3/3677 |

* cited by examiner

*Primary Examiner* — Abbas I Abdulselam
(74) *Attorney, Agent, or Firm* — Calfee, Halter & Griswold LLP

(57) ABSTRACT

A chip-on-film and a display device. The chip-on-film includes a substrate, at least one chip on the substrate, input terminals on the substrate, and output terminals on the substrate. The input terminals are configured to receive printed-circuit-board signals. The output terminals include data signal output sub-terminals configured to output display panel data signals. The output terminals lack an output sub-terminal configured to output a display panel scanning signal.

13 Claims, 8 Drawing Sheets

| serial number | 84 | 83 | 81-82 | 77-80 | 73-76 | 69-72 | 65-68 | 61-64 | 57-63 | 53-56 | 49-52 | 45-48 | 41-44 | 37-40 | 33-36 | 29-32 | 25-28 | 21-24 | 17-20 | 13-16 | 9-12 | 7-8 | 3-6 | 2 | 1 |
|---|---|---|---|---|---|---|---|---|---|---|---|---|---|---|---|---|---|---|---|---|---|---|---|---|---|
| name | DUMMY | NULL | GND | FEED | VCOM2 | STV1 | CLK1 | CLK2 | CLK3 | CLK4 | CLK5 | CLK6 | CLK7 | CLK8 | CLK9 | CLK10 | VDDO | VDDE | LVGL | STV0 | VGL | GOUT | VCOM1 | NULL | DUMMY |
| quantity | 1 | 1 | 2 | 4 | 4 | 4 | 4 | 4 | 4 | 4 | 4 | 4 | 4 | 4 | 4 | 4 | 4 | 4 | 4 | 4 | 4 | 2 | 4 | 1 | 1 |

CHIP-ON-FILM AND DISPLAY DEVICE

RELATED APPLICATIONS

The present application claims the benefit of Chinese Patent Application No. 201920184093.6, filed on Jan. 29, 2019, the contents of which are incorporated herein by reference in their entirety.

FIELD

The present disclosure relates to the field of display technologies, and in particular, to a chip-on-film and a display device.

BACKGROUND

At present, in a display device, a chip-on-film (COF) is often used to connect a display panel and a printed-circuit-board (PCB), and to transmit electrical signals therebetween. However, the related COFs have defects.

SUMMARY

According to an exemplary embodiment, there is provided a chip-on-film, comprising: a substrate, at least one chip on the substrate, input terminals on the substrate, and output terminals on the substrate. The input terminals are configured to receive printed-circuit-board signals. The output terminals comprise data signal output sub-terminals configured to output display panel data signals, and lack an output sub-terminal configured to output a display panel scanning signal.

In some exemplary embodiments, the at least one chip comprises two chips.

In some exemplary embodiments, the output terminals are arranged in one row.

In some exemplary embodiments, the output terminals further comprise Dummy output sub-terminals and Null output sub-terminals, the Dummy output sub-terminals are configured to output display panel Dummy signals, and the Null output sub-terminals are in a non-contacting state, wherein the Dummy output sub-terminals and the Null output sub-terminals are at two ends of the row of the output terminals, respectively.

In some exemplary embodiments, the output terminals are arranged in two rows.

In some exemplary embodiments, the output terminals further comprise Dummy output sub-terminals and Null output sub-terminals, the Dummy output sub-terminal are configured to output display panel Dummy signals, and the Null output sub-terminals are in a non-contacting state, wherein the Dummy output sub-terminals and a first portion of the data signal output sub-terminals form a first one of the two rows of the output terminals, and the Dummy output sub-terminals are at two ends of the first one of the two rows of the output terminals, and wherein the Null output sub-terminals and a second portion of the data signal output sub-terminals form a second one of the two rows of the output terminals, and the Null output sub-terminals are at two ends of the second one of the two rows of the output terminals.

In some exemplary embodiments, the output terminals further comprise common electrode signal output sub-terminals configured to output display panel common electrode signals.

According to another exemplary embodiment, there is provided a display device, comprising a display panel, a printed-circuit-board, at least one first chip-on-film connecting the display panel and the printed-circuit-board, and at least one connecting component connecting the display panel and the printed-circuit-board. Each of the at least one first chip-on-film comprises a first substrate, a first chip on the first substrate, first input terminals on the first substrate, and first output terminals on the first substrate. The first input terminals are configured to receive printed-circuit-board signals. The first output terminals comprise data signal output sub-terminals configured to output display panel data signals, and lack an output sub-terminal configured to output a display panel scanning signal. The display panel comprises scanning signal input terminals configured to receive the display panel scanning signals and data signal input terminals configured to receive the display panel data signals, the scanning signal input terminals are electrically connected to the printed-circuit-board through the connecting component, and the data signal input terminals are electrically connected to the printed-circuit-board through the data signal output sub-terminals.

In some exemplary embodiments, the scanning signal input terminals and the data signal input terminals are arranged in a first row, and the scanning signal input terminals are at two ends of the first row.

In some exemplary embodiments, the at least one connecting component comprises two or more connecting components, and the at least one first chip-on-film and the two or more connecting components are arranged in a second row, and the two or more connecting components are arranged at two ends of the second row, wherein the scanning signal input terminals at one of the two ends of the first row is connected to the printed-circuit-board through the connecting component at a corresponding one of the two ends of the second row.

In some exemplary embodiments, the display panel comprises GOA circuits and the scanning signal input terminals are connected to the GOA circuits.

In some exemplary embodiments, the at least one connecting component comprises a flexible printed-circuit-board.

In some exemplary embodiments, the flexible printed-circuit-board is directly bound to the printed-circuit-board.

In some exemplary embodiments, the flexible printed-circuit-board is connected to the printed-circuit-board through a connector.

In some exemplary embodiments, the display panel comprises gate lines, and the scanning signal input terminals are connected to the gate lines.

In some exemplary embodiments, the at least one connecting component comprises a second chip-on-film, the second chip-on-film comprises a second substrate and a second chip, second input terminals, and second output terminals on the second substrate, wherein the second input terminals are bound to the printed-circuit-board, and the second output terminals are bound to the scanning signal input terminals.

BRIEF DESCRIPTION OF THE DRAWINGS

In order to more clearly explain the technical solutions of the embodiments of the present disclosure or the technical solutions in the related art, the drawings used in application will be briefly described below. The drawings only show a portion of the embodiments of the present disclosure. Other embodiments may also be obtained from these drawing by those of ordinary skill in the art.

DETAILED DESCRIPTION

The technical solutions of exemplary embodiments will be described below with reference to the accompanying drawings. The described embodiments are only parts of the embodiments of the disclosure, rather than all of the embodiments. All other embodiments obtained by the person having ordinary skill in the art based on the exemplary embodiments described in the present disclosure without paying creative effort belong to the protective scope of the disclosure.

With the rapid development of display technologies, the demand for large-size and high-resolution display panels is gradually increasing. The large-size and high-resolution display panel has a large number of signal lines, which increases the number of signal input terminals connected to the signal lines.

Figure 1:
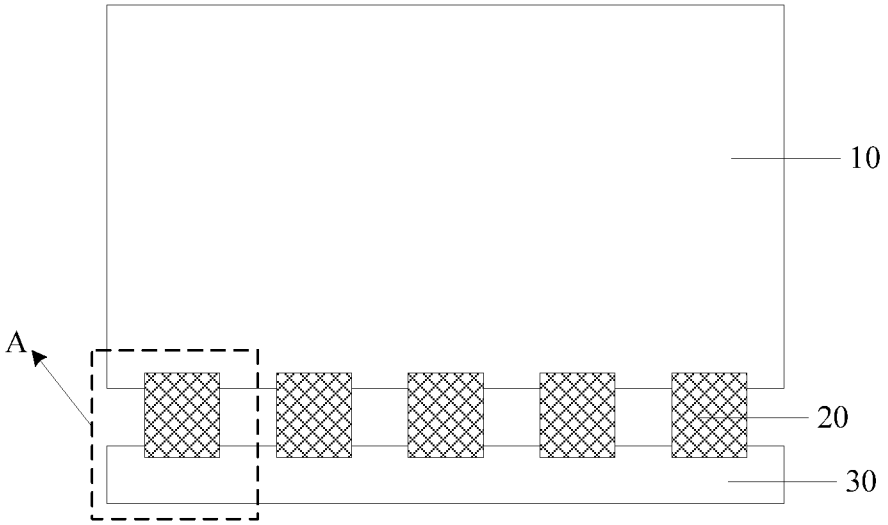
(Related Art) FIG. 1
FIG. 1 schematically shows the structure of a related display device.
Figure 2:
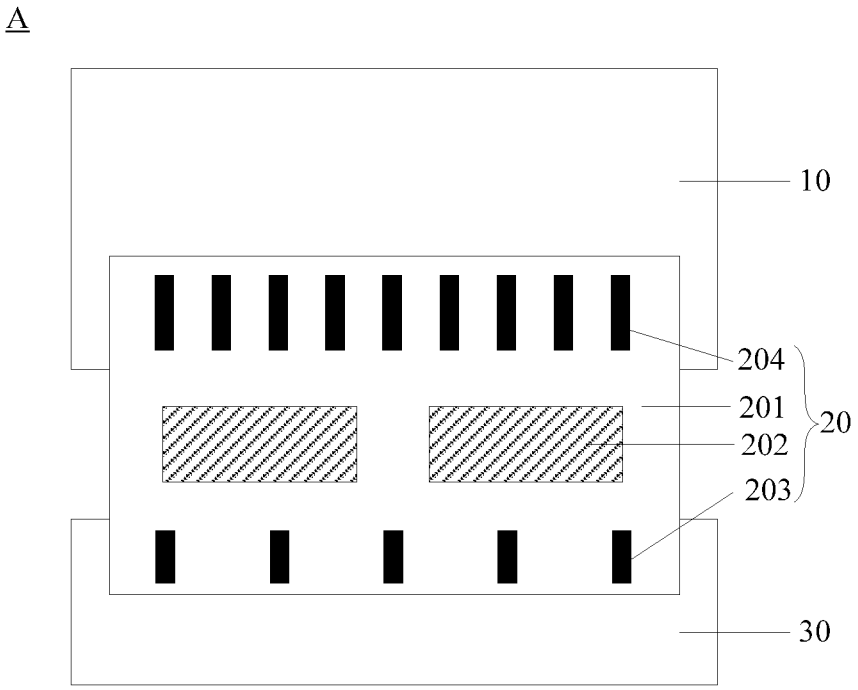
(Related Art) FIG. 2
FIG. 2 schematically shows an enlarged view of the location A of FIG. 1.

In order to achieve a narrow border, a display panel could often use a single-side drive mode to drive the display of pixels. FIG. 1 shows the structure of related display device and FIG. 2 shows an enlarged view of a portion of the display device of FIG. 1, which is surrounded by a dashed box A. As shown in FIG. 1, the signal input terminals of the display panel 10 are located at the same side of the display panel 10. The signal input terminals are electrically connected to the PCB 30 through a plurality of COFs 20. As shown in FIG. 2, a COF 20 comprises a substrate 201, a chip 202 on the substrate 201, input terminals 203 on one side of the substrate 201, and output terminals 204 on the other side of the substrate 201. The input terminals 203 are configured to be electrically connected (e.g., bound) to the PCB 30, and the output terminals 204 are configured to be electrically connected to the signal input terminals of the display panel 10.

In the related art, when a COF comprises one chip (i.e., the so called "1 Chip in 1 Film" structure), 48 COFs are generally required to bind the signal input terminals of the display panel to the PCB. However, it is difficult for the limited space inside the display device to accommodate such many COFs, so COFs comprising two chips (i.e., the so called "2 Chips in 1 Film" structure) are often used.

However, in the situation that a COF comprises two chips, the number of the output terminals comprised by a COF increases, so the spacing between two adjacent output terminals has to be very small, generally less than 30 μm. Thus, when the signal input terminals of the display panel are bound to the output terminals 204 of the COFs, there may be a risk of Bonding Miss or Short.

Figure 3:
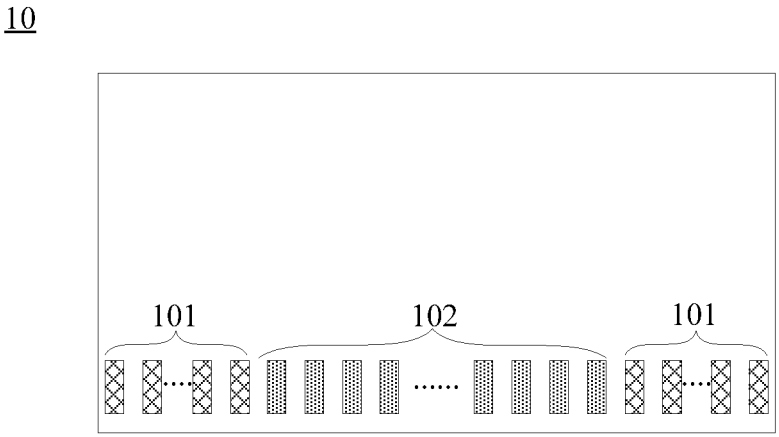
(Related Art) FIG. 3
FIG. 3 schematically shows the arrangement of signal input terminals of a related display panel.
Figure 4:
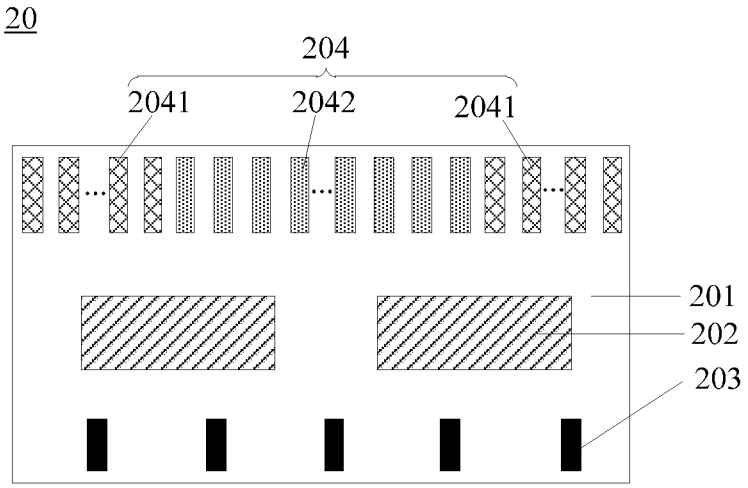
(Related Art) FIG. 4
FIG. 4 schematically shows the structure of a related COF.

FIG. 3 shows the arrangement of the signal input terminals of a related display panel. As shown in FIG. 3, the signal input terminals of the display panel 10 comprise data signal input terminals 102 and scanning signal input terminals 101. Since the data signal is typically transmitted to the source electrode (the source) of the driving transistor of the pixel, the data signal is also referred to as the source signal. Since the scanning signal is typically transmitted to the gate electrode (the gate) of the driving transistor of the pixel, the scanning signal is also referred to as the gate signal. For a single-side driven display panel, the data signal input terminals 102 and the scanning signal input terminals 101 are located at the same side, for example in one row, with the data signal input terminals 102 being placed in the middle of the row and the scanning signal input terminals 101 being placed at the two ends of the row. FIG. 4 shows the structure of a related COF. As shown in FIG. 4, the output terminals 204 comprise data signal output sub-terminals 2042 and scanning signal output sub-terminals 2041 located beside two ends of the row of the data signal output sub-terminals. The data signal output sub-terminals 2042 are configured to be connected to the data signal input terminals 102 of the display panel 10 and configured to send display panel data signals to the data signal input terminals of the display panel. The scanning signal output sub-terminals 2041 are configured to be connected to the scanning signal input terminals 101 of the display panel 10 and configured to transmit display panel scanning signals to the scanning signal input terminals of the display panel. When the display panel 10 is bound to a plurality of COFs 20, since the scanning signal input terminals 101 are only located on two ends of the row of the data signal input terminals 102, only the scanning signal output sub-terminals 2041 of the COFs at two ends of the row of the COFs are connected with the scanning signal input terminals 101. Specifically, the scanning signal output sub-terminals 2041 located at the left half of the leftmost COF are connected to the scanning signal input terminals 101 next to the left end of the row of data signal input terminals 102, and the scanning signal output sub-terminals 2041 located at the right half of the rightmost COF are connected to the scanning signal input terminals 101 next to the right end of the row of the data signal input terminals 102. The data signal output sub-terminals 2042 of the remaining COFs located between the leftmost COF and the rightmost COF is connected to the data signal input terminals 102, and the scanning signal output sub-terminals 2041 of the remaining COFs and the scanning signal output sub-terminals 2041 located at the right half of the leftmost COF and the scanning signal output sub-terminals 2041 located at the left half of the rightmost COF are in the non-contacting state. The term "non-contacting state" means that the output terminal does not connect to any signal input terminal. Therefore, the utilization of the output terminal 204 of the COF 20 is not high, and a large number of scanning signal output sub-terminals 2041 which are in the non-contacting state occupy the space of the COF 20, resulting in a very small spacing between the two adjacent output sub-terminals of the output terminals 204.

According to exemplary embodiments, there is provided a chip-on-film and a display device that solve the problem of small spacing between the two adjacent output sub-terminals in the chip-on-film.

Figure 5:
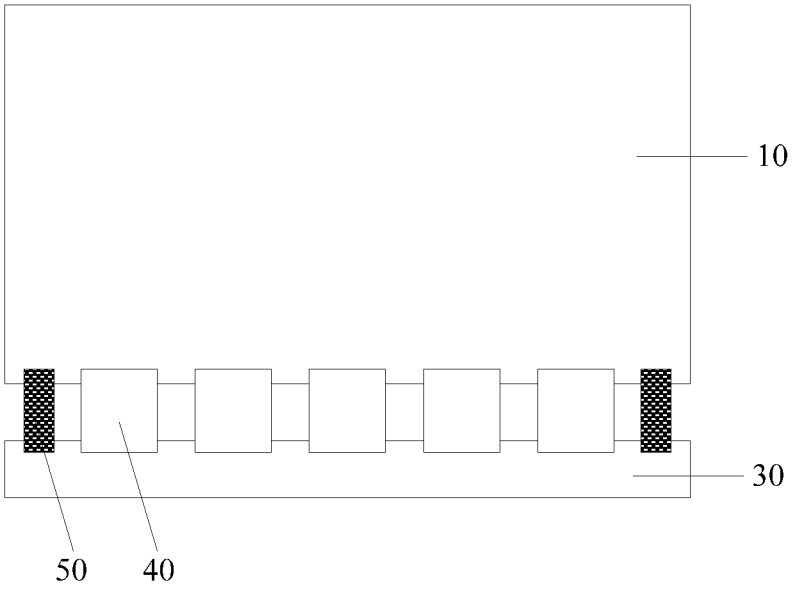
FIG. 5 schematically shows the structure of a display device according to an exemplary embodiment.

FIG. 5 schematically shows the structure of a display device according to an exemplary embodiment. As shown in FIG. 5, the display device comprises a display panel 10, a PCB 30, first COFs 40, and connecting components 50. Both the first COFs 40 and the connecting components 50 are configured to physically and electrically connect the display panel and the PCB. The display panel 10 comprises a plurality of scanning signal input terminals 101 and a plurality of data signal input terminals 102. The plurality of scanning signal input terminals 101 are connected to the PCB 30 through the connecting components 50. The plurality of data signal input terminals 102 are bound to the PCB 30 through the first COFs 40.

The signal input terminals of the display panel 10 comprise, but are not limited to, the scanning signal input terminals 101, the data signal input terminals 102, and the common electrode signal input terminals. It should be understood that the data signal input terminals 102 are connected to the data lines of the display panel 10. In the situation where the display panel 10 comprises Gate-on-Array (GOA) circuits, the scanning signal input terminals 101 are connected to the GOA circuits, and the GOA circuits are also connected to the gate lines. In the situation where the display panel 10 does not comprise GOA circuits, the scanning signal input terminals 101 are connected to the gate lines.

In the related display devices, the scanning signal input terminals 101 and the data signal input terminals 102 are both connected to the PCB 30 through the COF 20. However, in the embodiments of the present disclosure, the scanning signal input terminals 101 are connected to the PCB 30 through the connecting components 50, and the data signal input terminals 102 are connected to the PCB 30 through the first COFs 40. Therefore, in the embodiments of the present disclosure, the scanning signal input terminals 101 and the data signal input terminals 102 of the display panel are connected to the PCB in different ways.

Figure 6A:
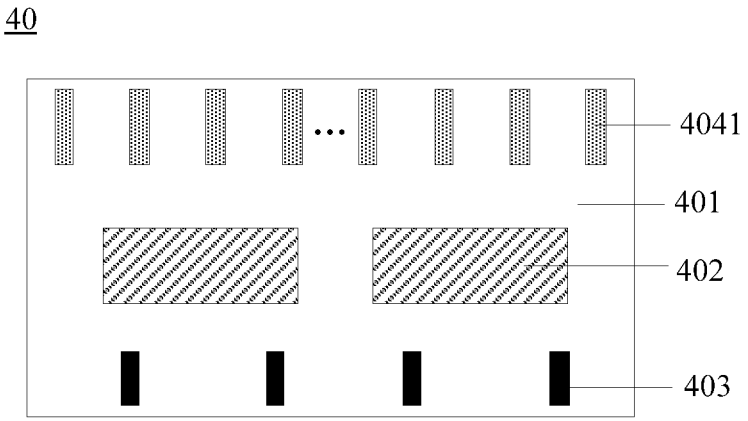
FIGS. 6A, 6B, 7-9, 10A, and 10B schematically show the structures of the COFs according to various exemplary embodiments.
Figure 6B:
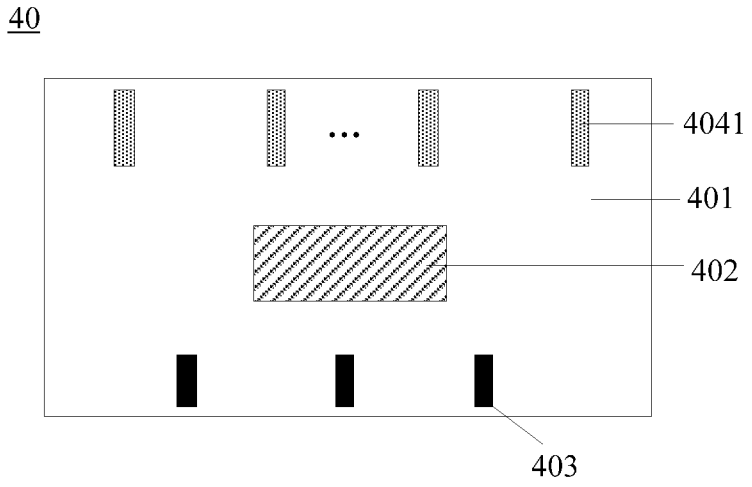

FIGS. 6A and 6B schematically show the structures of the COFs according to exemplary embodiments. The COF 40 comprises a substrate 401, at least one chip (e.g., an Integrated Circuit) 402 on the substrate 401, input terminals 403 and output terminals on the substrate 401. The input terminals 403 are configured to receive PCB signals. That is, when the COF is applied to the display device, the input terminals of the COF are connected to the PCB 30. The output terminals comprise a plurality of data signal output sub-terminals 4041. The data signal output sub-terminals 4041 are configured to output the display panel data signals. When the COF is applied to the display device, the data signal output sub-terminals 4041 of the COF are connected to the data signal input terminals 102 of the display panel 10. The output terminals 404 of the COF of the present application lack the output sub-terminal connected to the scanning signal input terminal 101 of the display panel 10, i.e., the output sub-terminal configured to be connected to the scanning signal input terminal 101 of the display panel 10 is absent in the output terminals 404. That is to say, there is no output sub-terminal for outputting the scanning signal in the COF. Since the output sub-terminals for outputting the scanning signals are omitted, the spacing between the two adjacent output terminals of the COF according to the embodiments of the present disclosure is larger, the arrangement of the output terminals can be looser, and the risk of Bonding Miss is reduced.

It should be noted that, when the plurality of data signal input terminals 102 of the display panel are electrically connected to the PCB 30 through the COFs 40, the input terminals 403 of the COF 40 is electrically connected to the PCB 30, and each one of the plurality of data signal output sub-terminals 4041 of the COF 40 are connected to a corresponding one of the plurality of data signal input terminals 102 of the display panel 10. That is, the quantity of the plurality of data signal output sub-terminals 4041 of the COFs are the same as the quantity of the plurality of data signal input terminals of the display panel 10, and the data signal output sub-terminals and the data signal input terminals have a one-to-one correspondence.

The quantity of the ICs on the COF has different embodiments. In the exemplary embodiment shown in FIG. 6B, the COF 40 comprises one IC 402 located on the substrate 401. In the exemplary embodiment shown in FIG. 6A, the COF 40 comprises two ICs 402 located on a substrate 401. In other exemplary embodiments, the COF 40 may comprise more than two ICs 402 located on the substrate 401. Since the area of the substrate 401 of the COF 40 is limited and a larger quantity of ICs will result in a larger quantity of output terminals 404, a COF 40 is not suitable for comprising too many ICs. If a COF comprises too many ICs, the quantity of the output terminals of the COF will increase, which may result in a very small Bonding Pitch between the adjacent output terminals and even the contact among the output terminals. Based on the above facts, in some exemplary embodiments, the quantity of ICs 402 comprised by a COF 40 is two at most.

In addition, if a COF 40 comprises only one IC 402, then the quantity of data signal output sub-terminals 4041 of the COF 40 is too small. For the same display panel (i.e., the quantity of data signal input terminals 102 of the display panel is the same), more COFs 40 are required. Since the size of the display panel 10 is limited, the quantity of COFs 40 that can be arranged of the display panel is also limited. Therefore, in some exemplary embodiments, one COF 40 comprises two ICs 402.

The plurality of data signal output sub-terminals 4041 are connected to the plurality of data signals input terminals 10 of the display panel 10 in the one-to-one correspondence. When the spacing between the two adjacent data signal output sub-terminals 4041 of the COF 40 changes, the spacing between the two adjacent data signal input terminals 102 of the display panel 10 also changes accordingly.

In some exemplary embodiments, the quantity of output terminals 404 of the COF is greater than the quantity of input terminals 403.

The quantity of data signal output sub-terminals 4041 of a COF can be set as needed. In an exemplary embodiment where one COF 40 comprises one IC 402, the COF 40 can be set to comprise 960 data signal output sub-terminals 4041. In an exemplary embodiment where one COF 40 comprises two ICs 402, the COF 40 can be set to comprise 1920 data signal output sub-terminals 4041.

The difference between the arrangement densities of the output terminals of the COF of an exemplary embodiment and the output terminals of the related COF is explained below. In the example where a display panel 10 comprises 176 scanning signal input terminals 101 (wherein the scanning signal input terminals 101 are arranged at both ends of the row of the data signal input terminals 102, and each end of the row of the data signal input terminals 102 is arranged with 88 scanning signal input terminals 101) and one COF is configured to connect with 1932 input terminals comprising the data signal input terminals 102 and other input terminals but not the scanning signal input terminals, since the related COF comprises both the scanning signal output sub-terminals connected with the scanning signal input terminals of the display panel and configured to output the display panel scanning signals and the data signal output sub-terminals connected with the data signal input terminals of the display panel and configured to output the display panel data signals, the related COF comprises 2108 (1932+176) output terminals. However, in the COF of the embodiments of the present disclosure, the COF 40 does not comprise the output sub-terminal configured to output the display panel scanning signal, so the quantity of output sub-terminals of the COF 40 is 1932. The quantity of output terminals of the COF 40 of the embodiments of the present disclosure is reduced by 176, comparing with the related COF.

Figure 7:
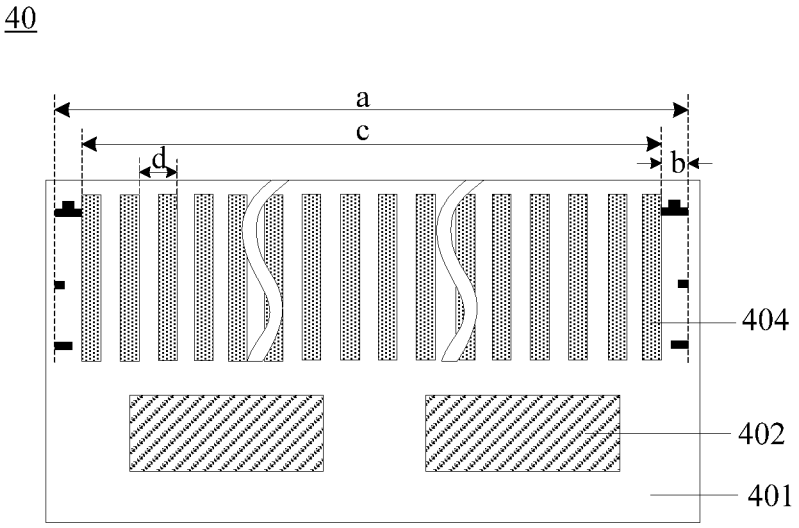

Below is a specific calculation of the spacing between adjacent output sub-terminals of the COF 40. FIG. 7 schematically shows a top view of a COF in accordance with an exemplary embodiment. As shown in FIG. 7, "a" is the width of the Cu region of the COF 40. In the embodiment where the total width of the COF 40 is 70 mm, the ultimate width of the Cu region is 63000 μm. "b" is the width of the align mark of the COF 40. Each side of the COF respectively has an align mark, and the width of each of the align marks is 300 μm. Therefore, the total width of the row of the output terminals of the COF 40 is defined by: $c=63000-300\times 2=62400$ μm. As described above, the spacing "d" (i.e., the lead pitch) between the adjacent output terminals of the COF according to the embodiments of the present disclosure is about $62400\div 1932\approx 32$ μm. However, the spacing "d" between the adjacent output terminals of the related COF is about $62400\div 2108\approx 29$ μm. Since the spacing between adjacent output terminals in the related art is less than 30 μm, the risk of Bonding Miss is extremely high when the COF of the related art is bound to the display panel 10. In the embodiments of the present disclosure, the risk of Bonding Miss can be avoided when the COF 40 is bound to the display panel 10, because the spacing between adjacent output terminals is greater than 30 μm.

Comparing with the related art where the output terminals of the COF comprise both the data signal output sub-terminals bound to the data signal input terminals 102 of the display panel 10 and the scanning signal output sub-terminals bound to the scanning signal input terminals 101 of the display panel 10, the output terminals 404 of the COF 40 of the embodiments of the present disclosure comprise the data signal output sub-terminals 4041 bound to the data signal input terminals 102 of the display panel 10, but lack the output sub-terminal bound to the scanning signal input terminal 101 of the display panel 10. Thus, the quantity of output terminals 404 of the COF 40 is less. When the size of the substrate 401 of the COF 40 remains the same, since the quantity of the output terminals 404 of the COF 40 according to exemplary embodiments is less, the spacing between the adjacent output terminals of the COF 40 is increased. Thus, when each of the data signal output sub-terminals 4041 of the COF 40 is bound to the corresponding one of the data signal input terminals 102 of the display panel 10, the risk of Bonding Miss and Short can be reduced. In addition, since the COF 40 of an exemplary embodiment does not contain an output sub-terminal bound to the scanning signal input terminal 101 of the display panel 10, it is avoided that a large amount of redundant output sub-terminals (i.e., the output sub-terminals present on the COF but are substantially useless) occupy the COF 40 and squeeze the room for the data signal output sub-terminals 4041. All of the output terminals of the COF 40 can be used to be connected to the signal input terminals of the display panel 10, which increases the utilization of the output terminals of the COF 40.

In some exemplary embodiments, the data signal input terminals 102 of the display panel 10 are connected to the PCB 30 through the COFs 40, and the scanning signal input terminals 101 are connected to the PCB 30 through the connecting components 50. Therefore, the spacing between the adjacent scanning signal input terminals 101 of the display panel 10 can be set larger, and the spacing between the adjacent scanning signal output terminals on the connecting component 50 that are to be connected to the scanning signal input terminals 101 of the display panel can be set larger, which improves the connecting quality between the connecting component 50 and the scanning signal input terminals 101 of the display panel 10, and ensures the intensity and transmission quality of the scanning signal.

The COF 40 according to exemplary embodiments may be configured to bind the data signal input terminals of the display panel 10 of the 1G1D architecture to the PCB 30, or may be configured to bind the data signal input terminals of the display panel 10 of the 2G2D architecture (e.g., a display panel of 8K resolution and 120 Hz refresh rate) to the PCB 30. In the 1G1D display panel, one column of pixels is provided with one data signal line, and one row of pixels is provided with one scanning signal line (the gate line), and each scanning signal line is connected with the gates of the thin film transistors in the corresponding pixels. In each column of pixels, only a single pixel is charged in one scanning period. In the 2G2D display panel, each row of pixel corresponds to one scanning line, and the gate line of the $(2m)^{th}$ row of pixels and the gate line of the $(2m-1)^{th}$ row of pixels receive the same control signal, wherein m is a natural number greater than or equal to 1. Each column of pixels corresponds to two data lines, among which a first data line is connected to the sources of the transistors of the pixels located at the odd rows of the corresponding column of pixels, and a second data line is connected to the sources of the transistors of the pixels located at the even rows of the corresponding column of pixels.

Figure 8:
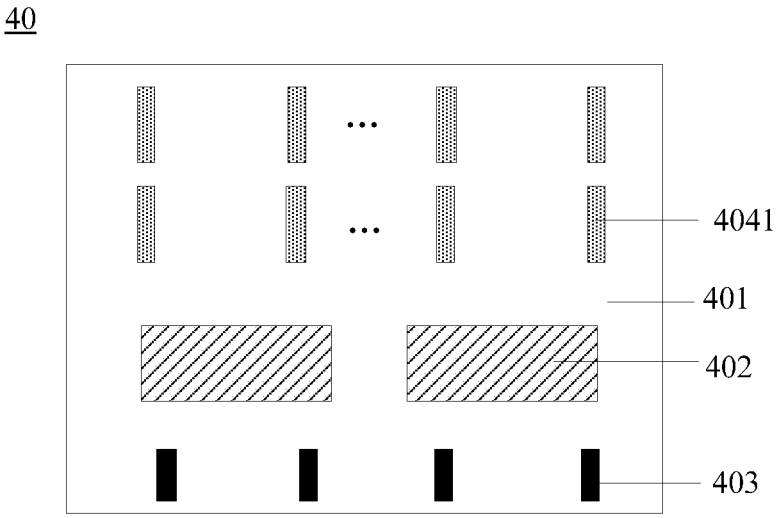

To facilitate the binding of the output terminals 404 of the COF 40 to the signal input terminals of the display panel 10, in some embodiments, all of the output terminals 404 can be arranged in one row (e.g., as shown in FIGS. 6A and 6B) or in two rows (e.g. as shown in FIG. 8).

If the output terminals 404 are arranged in two rows, in order to avoid the mutual influence between the two rows of output terminals, the COF 40 also comprises an insulation layer. One of the two rows of output terminals is bound to the signal input terminals of the display panel 10 through the wiring above the insulation layer, and the other one of the two rows of output terminals is bound to the signal input terminals of the display panel 10 through the wiring below the insulation layer.

Arranging the output terminals 404 into two rows can further increase the spacing between the adjacent output terminals, comparing with the situation where the output terminals 404 are arranged in one row, in the case where the quantities of the output terminals 404 of the COFs 40 are the same. Arranging the output terminals 404 into one row may simplify the fabrication process of the COF 40 and reduce the manufacturing cost of the COF 40, comparing with the situation where the output terminals 404 are arranged in two rows.

Figure 9:
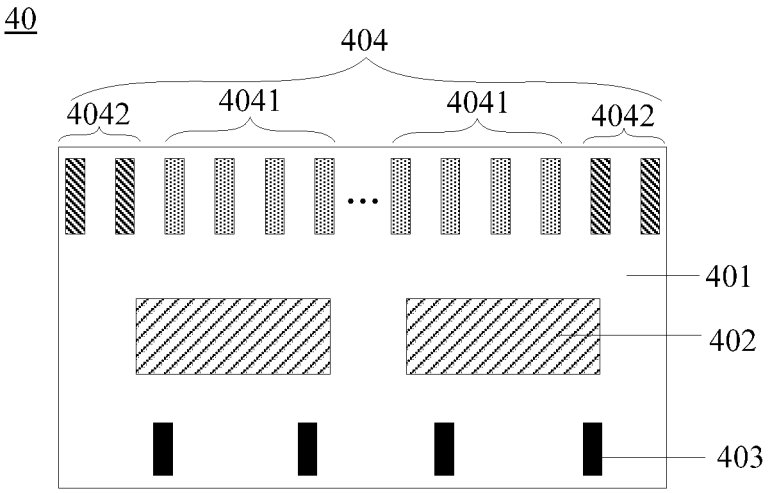

In some exemplary embodiments, for example as shown in FIG. 9, the output terminals 404 also comprise common electrode signal output sub-terminals 4042. The common electrode signal output sub-terminals 4042 are configured to output the common electrode signals. When the COF is connected to the display panel, the common electrode signal output sub-terminals 4042 are connected to the common electrode signal input terminal of the display panel 10.

It should be understood that the common electrode signal input terminals of the display panel 10 are connected to the common electrode lines in the display panel 10.

When the plurality of output terminals are arranged in a row, the positions of the common electrode signal output sub-terminals 4042 and the data signal output sub-terminals 4041 can have various embodiments. For example, the common electrode signal output sub-terminals 4042 and the data signal output sub-terminals 4041 may be arranged in a cross type, that is, a common electrode signal output sub-terminal may be sandwiched between two data signal output sub-terminals. Alternatively, the common electrode signal output sub-terminals and the data signal output sub-terminals may be arranged separately, that is, there is no data signal output sub-terminal between two adjacent common electrode signal output sub-terminals, and there is no common electrode signal output sub-terminal between two adjacent data signal output sub-terminals. Alternatively, as shown in FIG. 9, in the row formed by the common electrode signal output sub-terminals 4042 and the data signal output sub-terminals 4041, the common electrode signal output sub-terminals 4042 are located at the two ends of the row, and the data signal output sub-terminals 4041 are located between the two groups of common electrode signal output sub-terminals respectively at the two ends.

The quantity of the common electrode signal output sub-terminals 4042 that could be comprised by one COF 40 has various embodiments. For example, when a COF 40 comprises two ICs 402, the output terminals 404 comprise 8 common electrode signal output sub-terminals 4042 in some exemplary embodiments. In some more specific exemplary embodiments, each end of the row of data signal output sub-terminals 4041 may be provided with four common electrode signal output sub-terminals 4042.

The common electrode signal input terminals of the display panel 10 can be connected to the PCB through the common electrode signal output sub-terminals 4042, so that the common electrode lines of the display panel 10 can be electrically connected to the PCB 30 through the COF 40.

In some exemplary embodiments, as shown in FIG. 10, the output terminals 404 of the COF 40 also comprise Dummy output sub-terminals and Null output sub-terminals. The Dummy output sub-terminals and the Null output sub-terminals are closer to the ends of the row of output terminals comparing with other output terminals. The Dummy output sub-terminals are configured to output Dummy signals. When the display panel is connected to the COF, the Dummy output sub-terminals are connected to the Dummy signal input terminals of the display panel 10, and the Dummy signal input terminals are connected to the Dummy signal lines of the display panel 10. The Null output sub-terminals are in the non-contacting state (i.e., not in contact with any signal input terminal of the display panel 10). Both the Dummy output sub-terminals and the Null output sub-terminals are bound to the PCB 30 through the wirings on the COF 40.

Figure 10A:
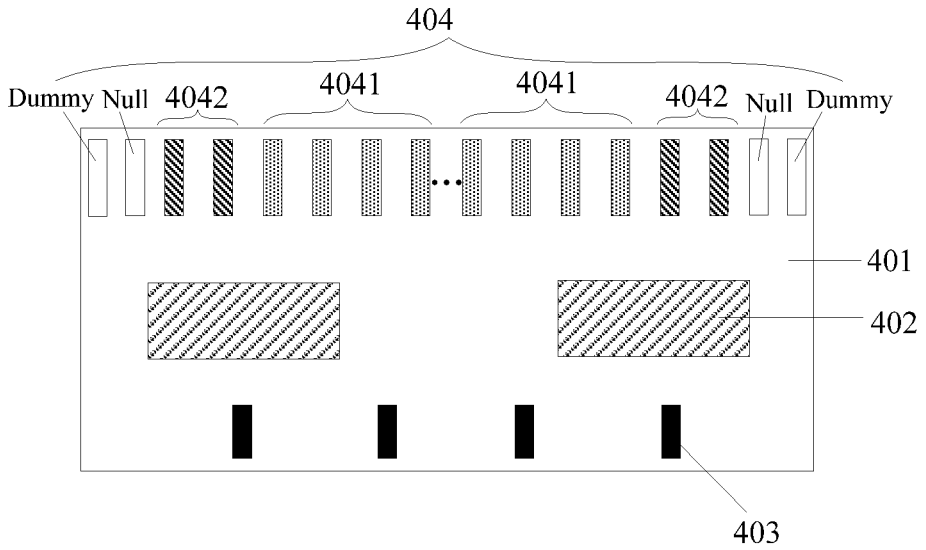

When the output terminals of the COF are arranged in one row, the Dummy output sub-terminals and the Null output sub-terminals may be located at the two ends of the row of the output terminals. In some exemplary embodiments, the Null output sub-terminals are further outside the row than the Dummy output sub-terminals, as shown in FIG. 10A. In other embodiments, the Dummy output sub-terminals are further outside the row than the Null output sub-terminals.

Figure 10B:
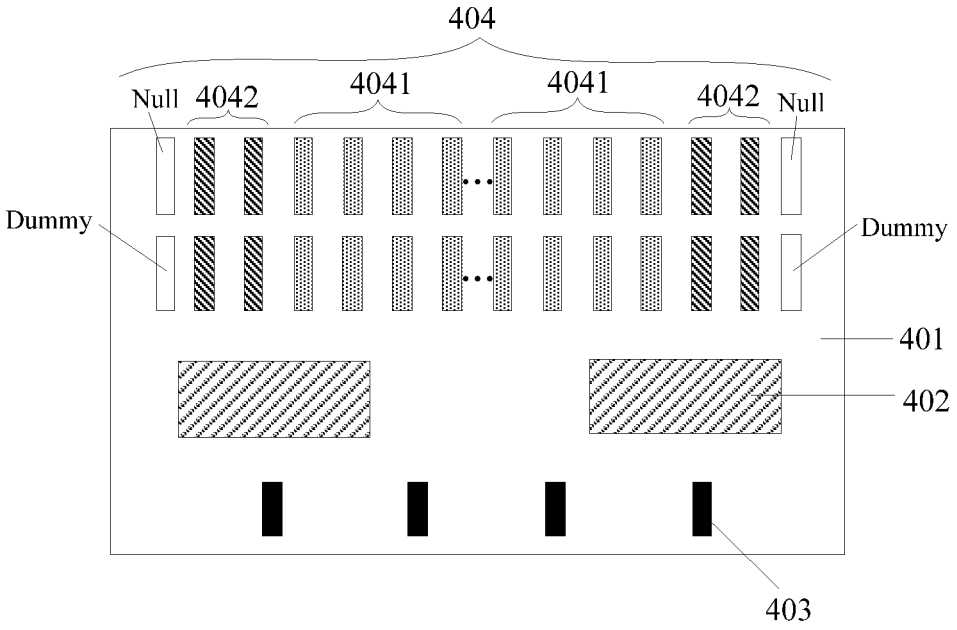

When the output terminals of the COF are arranged in two rows, the Dummy output sub-terminals and a first portion of the data signal output sub-terminals form the first row of the two rows, and the Dummy output sub-terminals are located at the two ends of the first row. The Null output sub-terminals and a second portion of the data signal output sub-terminals form the second row of the two rows, and the Null output sub-terminals are located at the two ends of the second row, as shown in FIG. 10B.

In some exemplary embodiments, the Dummy output sub-terminals and the Null output sub-terminals may be set on one side of data signal output sub-terminals 4041. In some other embodiments, the Dummy output sub-terminals and the Null output sub-terminals may be set on both sides of the data signal output sub-terminals 4041.

Since the Dummy output sub-terminals and the Null output sub-terminals are closer to the ends of the row of output terminals comparing with the other output terminals of the COF, the Dummy output sub-terminals and the Null output sub-terminals can protect the other output terminals.

When the plurality of data signal input terminals 102 of the display panel 10 are bound to the PCB 30 through the COF 40, the quantity of COFs 40 can be selected as needed.

In some exemplary embodiments, the display device comprises two connecting components located at the two ends of the row of COFs. The scanning signal input terminals located at one end of the row of the input terminals of the display panel are connected to the PCB through a corresponding one of the connecting components located at one of the two ends of the row of COFs.

The connecting component 50 can have various embodiments, so long as the connecting component 50 can electrically connect the scanning signal input terminals 101 of the display panel to the PCB 30.

Figures 11, 12A:
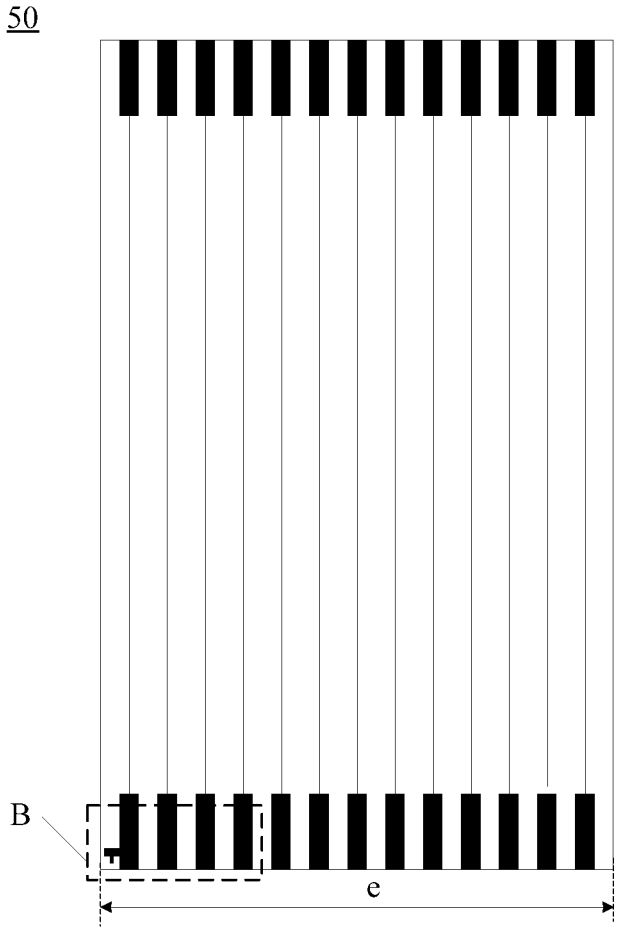
FIG. 11 schematically shows the quantities and locations of various terminals of scanning signal input terminals of a connecting component according to an exemplary embodiment.
FIG. 12A schematically shows the structure of a connecting component according to an exemplary embodiment.

In the case that the display panel 10 comprises GOA circuits, the scanning signal input terminals 101 of the display panel is connected to the GOA circuit. The GOA circuit comprises a STV input terminal, a CLK input terminal, a VDDO input terminal, a VDDE input terminal, a LVGL input terminal, a VGL input terminal, a GOUT input terminal, a VCOM input terminal, a FEED input terminal, a GND terminal, a Dummy input terminal, and a Null input terminal. Correspondingly, the scanning signal input terminals 101 comprise the signal input terminal connected to the STV input terminal, the signal input terminal connected to the CLK input terminal, the signal input terminal connected to the VDDO input terminal, the signal input terminal connected to the VDDE input terminal, the signal input terminal connected to the LVGL input terminal, the signal input terminal connected to the VGL input terminal, the signal input terminal connected to the GOUT input terminal, the signal input terminal connected to the VCOM input terminal, the signal input terminal connected to the FEED input terminal, the signal input terminal connected to the GND terminal, the signal input terminal connected to the Dummy input terminal, and the signal input terminal connected to the Null input terminal. The quantities and locations of the various signal input terminals of the scanning signal input terminals 101 have various embodiments, and can be selected as needed. FIG. 11 schematically shows the quantities and locations of the various signal input terminals of the scanning signal input terminals 101. As shown in FIG.

11, the scanning signal input terminals 101 are arranged from right to left and from No. 1 to No. 84.

In the case where the display panel 10 comprises GOA circuits and the scanning signal input terminals 101 are connected to the GOA circuits, the connecting component 50 may be a flexible printed circuit board (FPC) in some embodiments, as shown in FIG. 12A. One end of the FPC is connected to the scanning signal input terminals 101, and the other end is connected to the PCB 30.

Figure 13:
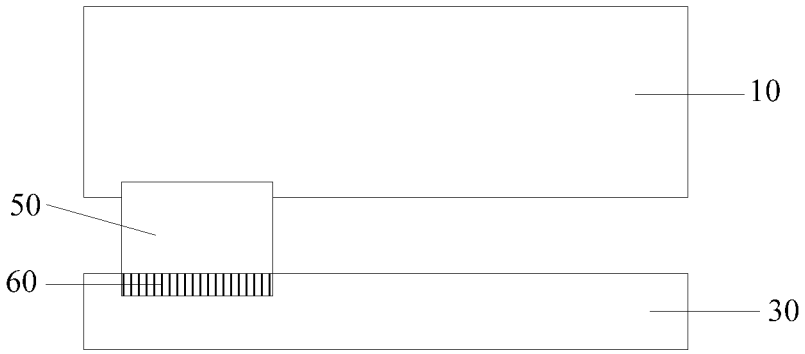
FIG. 13 schematically shows the structure of a display device according to an exemplary embodiment.

It should be noted that, in some exemplary embodiments, the FPC is directly bound to the PCB 30. In some other embodiments, as shown in FIG. 13, the FPC is connected to the PCB 30 through a connector (CNT) 60.

In the case that the FPC is connected to the PCB 30 through the connector 60, the connection requires an operator to plug and unplug. When the FPC is directly bound to the PCB 30, a binding process is required.

Figure 12B:
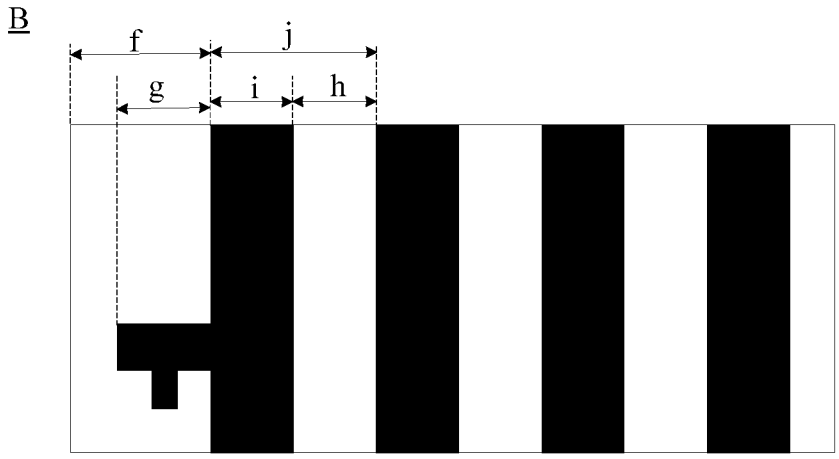
FIG. 12B schematically shows an enlarged view of the location B of FIG. 12A.

The spacing between the adjacent terminals on the FPC is exemplarily calculated below. As shown in FIG. 12A, the total width "e" of the FPC is 7745 μm. As shown in FIG. 12B, the distance "f" between the terminal of the FPC and the edge of the FPC is 800 μm. The width "g" of the align mark of the FPC is 300 μm. Taking the total number of terminals as 84 as an example, the space "h" between the adjacent terminals is 35 μm, and the width "i" of the terminal is also 35 μm. Therefore, the distance (i.e., the pitch) "j" between the adjacent terminals is defined by: $j=i+h=70$ μm. As can be seen, in some embodiments of the present disclosure, the spacing between the adjacent scanning signal output sub-terminals in the FPC connected to the scanning signal input terminal 101 is much larger than the spacing between the adjacent scanning signal output sub-terminals in the related COF. This guarantees the scanning signal intensity and the transmission quality. The align mark on the FPC is configured for aligning the binding device.

In some exemplary embodiments, a display panel 10 comprises gate lines, and the scanning signal input terminals 101 are connected to the gate lines. In this case, the connecting components 50 may be another kind of COF that is different from the aforementioned COF. This other kind of COF comprises at least one IC (also referred to as a scan drive IC) located on the substrate, a plurality of input terminals, and a plurality of output terminals. The plurality of input terminals are bound to the PCB 30, and the plurality of output terminals are bound to the plurality of scanning signal input terminals 101 of the display panel.

In summary, the present disclosure provides a chip-on-film, comprising a substrate, at least one chip on the substrate, input terminals on the substrate, and output terminals on the substrate. The input terminals are configured to receive printed-circuit-board signals. The output terminals comprise data signal output sub-terminals configured to output display panel data signals, and lack an output sub-terminal configured to output a display panel scanning signal.

The present disclosure further provides a display device, comprising a display panel, a printed-circuit-board, at least one first chip-on-film connecting the display panel and the printed-circuit-board, and at least one connecting component connecting the display panel and the printed-circuit-board. Each of the at least one first chip-on-films comprises a first substrate, a first chip on the first substrate, first input terminals on the first substrate, and first output terminals on the first substrate. The first input terminals are configured to receive printed-circuit-board signals. The first output terminals comprise data signal output sub-terminals configured to output display panel data signals, and lack an output sub-terminal configured to output a display panel scanning signal. The display panel comprises scanning signal input terminals configured to receive the display panel scanning signals and data signal input terminals configured to receive the display panel data signals. The scanning signal input terminals are electrically connected to the printed-circuit-board through the connecting component. The data signal input terminals are electrically connected to the printed-circuit-board through the data signal output sub-terminals.

In contrast to the related COF where the output terminals thereon comprise both the data signal output sub-terminals and the scanning signal output sub-terminal, the COF according to the exemplary embodiments comprises the data signal output sub-terminals bound to the data signal input terminals of the display panel and configured to output the display panel data signals, and lack the scanning signal output sub-terminal bound to the scanning signal input terminals and configured to output a display panel scanning signal. Thus, the quantity of the output terminals comprised by the COF is smaller. If the size of the substrate of the COF remains the same, the spacing between the adjacent output terminals of the COF is larger due to the smaller quantity of output terminals. In this way, when the data signal output sub-terminals of the COF are bound to the plurality of data signal input terminals on the display panel, the risk of Bonding Miss and Short can be avoided. In addition, since the output sub-terminal for outputting scanning signal is omitted in the COF, a large number of redundant output terminals no longer occupy the space of the COF, and the utilization of the output terminals on the COF is improved.

Since the data signal input terminals and the scanning signal input terminals are connected to the PCB through respectively the COFs and the connecting components, the spacing between the adjacent scanning signal output terminals on the connecting component and the spacing between the adjacent scanning signal input terminals on the display panel can be set to be larger, thereby improving the intensity and transmission quality of the scanning signal.

It will be appreciated that the above embodiments have been described only by way of example. While exemplary embodiments have been illustrated and described in detail in the drawings and foregoing description, such illustration and description are to be considered illustrative or exemplary and not restrictive, and the invention is not limited to the disclosed exemplary embodiments.

Other variations to the disclosed exemplary embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs should not be construed as limiting the scope. The usages of the words such as first and second etcetera do not indicate any ordering. These words are to be interpreted as names.

We claim:

1. A chip-on-film, comprising:

a substrate, at least one chip on the substrate, input terminals on the substrate, wherein the input terminals are configured to receive printed-circuit-board signals, and output terminals on the substrate, wherein the output terminals comprise data signal output sub-terminals configured to output display panel data signals, and lack an output sub-terminal configured to output a display panel scanning signal, wherein the output terminals are arranged in a row, wherein the output terminals further comprise Dummy output sub-terminals and Null output sub-terminals, the Dummy output sub-terminals are configured to output display panel Dummy signals and the Null output sub-terminals are in a non-contracting state, and wherein the Dummy output sub-terminals and the Null output sub-terminals are at two ends of the row of the output terminals respectively.

2. The chip-on-film of claim 1, wherein the at least one chip comprises two chips.

3. The chip-on-film of claim 1, wherein the output terminals further comprise common electrode signal output sub-terminals configured to output display panel common electrode signals.

4. A display device, comprising:

a display panel, a printed-circuit-board, at least one first chip-on-film connecting the display panel and the printed-circuit-board, and at least one connecting component connecting the display panel and the printed-circuit-board, wherein each of the at least one first chip-on-film comprises:

a first substrate, a first chip on the first substrate, first input terminals on the first substrate, wherein the first input terminals are configured to receive printed-circuit-board signals, and first output terminals on the first substrate, wherein the first output terminals comprise data signal output sub-terminals configured to output display panel data signals, and lack an output sub-terminal configured to output a display panel scanning signal, and wherein the display panel comprises scanning signal input terminals configured to receive the display panel scanning signals and data signal input terminals configured to receive the display panel data signals, the scanning signal input terminals are electrically connected to the printed-circuit-board through the connecting component, and the data signal input terminals are electrically connected to the printed-circuit-board through the data signal output sub-terminals, wherein the scanning signal input terminals and the data signal input terminals are arranged in a first row and the scanning signal input terminals are at two ends of the first row, wherein the at least one connecting component comprises two or more connecting components and the at least one first chip-on-film and the two or more connecting components are arranged in a second row, and the two or more connecting components are at two ends of the second row, wherein the scanning signal input terminals at one of the two ends of the first row is connected to the printed-circuit-board through the connecting component at a corresponding one of the two ends of the second row.

5. The display device of claim 4, wherein the display panel comprises GOA circuits and the scanning signal input terminals are connected to the GOA circuits.

6. The display device of claim 5, wherein the at least one connecting component comprises a flexible-printed-circuit-board.

7. The display device of claim 6, wherein the flexible-printed-circuit-board is directly bound to the printed-circuit-board.

8. The display device of claim 6, wherein the flexible-printed-circuit-board is connected to the printed-circuit-board through a connector.

9. The display device of claim 4, wherein the display panel comprises gate lines, and the scanning signal input terminals are connected to the gate lines.

10. The display device of claim 9, wherein the at least one connecting component comprises a second chip-on-film, the second chip-on-film comprises a second substrate and a second chip, second input terminals, and second output terminals on the second substrate, wherein the second input terminals are bound to the printed-circuit-board, and the second output terminals are bound to the scanning signal input terminals.

11. A chip-on-film, comprising:

a substrate, at least one chip on the substrate, input terminals on the substrate, wherein the input terminals are configured to receive printed-circuit-board signals, and output terminals on the substrate, wherein the output terminals comprise data signal output sub-terminals configured to output display panel data signals, and lack an output sub-terminal configured to output a display panel scanning signal, wherein the output terminals are arranged in two rows, wherein the output terminals further comprise Dummy output sub-terminals and Null output sub-terminals, the Dummy output sub-terminal are configured to output display panel Dummy signals, and the Null output sub-terminals are in a non-contacting state, wherein the Dummy output sub-terminals and a first portion of the data signal output sub-terminals form a first one of the two rows of the output terminals, and the Dummy output sub-terminals are at two ends of the first one of the two rows of the output terminals, and wherein the Null output sub-terminals and a second portion of the data signal output sub-terminals form a second one of the two rows of the output terminals, and the Null output sub-terminals are at two ends of the second one of the two rows of the output terminals.

12. The chip-on-film of claim 11, wherein the at least one chip comprises two chips.

13. The chip-on-film of claim 11, wherein the output terminals further comprise common electrode signal output sub-terminals configured to output display panel common electrode signals.

* * * * *